US008729375B1

(12) United States Patent
Bacigalupo

(10) Patent No.: US 8,729,375 B1
(45) Date of Patent: May 20, 2014

(54) PLATTER BASED ELECTRONIC MUSICAL INSTRUMENT

(71) Applicant: Synth Table Partners, Nashville, TN (US)

(72) Inventor: Peter Bacigalupo, Nashville, TN (US)

(73) Assignee: Synth Table Partners, Nashville, TN (US)

( * ) Notice: Subject to any disclaimer, the term of this patent is extended or adjusted under 35 U.S.C. 154(b) by 0 days.

(21) Appl. No.: 13/925,345

(22) Filed: Jun. 24, 2013

(51) Int. Cl.
*G10H 7/00* (2006.01)

(52) U.S. Cl.
USPC ..... 84/615; 84/653

(58) Field of Classification Search
USPC ..... 84/600–602, 615, 653
See application file for complete search history.

(56) References Cited

U.S. PATENT DOCUMENTS 2,138,875 A * 12/1938 Miessner ..... 369/53.39
2,924,138 A * 2/1960 Jones ..... 369/18
4,300,225 A * 11/1981 Lambl ..... 369/2
5,067,119 A * 11/1991 Yoshida et al. ..... 369/47.26
5,248,845 A * 9/1993 Massie et al. ..... 84/622
5,303,309 A * 4/1994 Rossum ..... 381/118
5,339,301 A * 8/1994 Raaymakers et al. ..... 369/47.12
5,342,990 A * 8/1994 Rossum ..... 84/603
5,350,882 A * 9/1994 Koguchi et al. ..... 84/636
5,353,275 A * 10/1994 Almonte ..... 369/189
5,602,356 A * 2/1997 Mohrbacher ..... 84/609
5,609,486 A * 3/1997 Miyashita et al. ..... 434/307 A
5,698,803 A * 12/1997 Rossum ..... 84/607
5,698,807 A * 12/1997 Massie et al. ..... 84/661
5,862,106 A * 1/1999 Washikawa et al. ..... 369/30.13
5,895,876 A * 4/1999 Moriyama et al. ..... 84/609
5,925,841 A * 7/1999 Rossum ..... 84/603
6,137,043 A * 10/2000 Rossum ..... 84/603
6,365,816 B1 * 4/2002 Rossum ..... 84/603
6,379,244 B1 * 4/2002 Sagawa et al. ..... 463/7
6,541,690 B1 * 4/2003 Segers, Jr. ..... 84/605
6,545,953 B1 * 4/2003 Herbert ..... 369/4
6,576,825 B2 * 6/2003 Yamada et al. ..... 84/602
6,687,193 B2 * 2/2004 Jung ..... 369/4
6,818,815 B2 * 11/2004 Cohen ..... 84/645
6,858,790 B2 * 2/2005 Rossum ..... 84/603
6,881,949 B2 * 4/2005 Spencer ..... 250/231.13
6,961,289 B2 * 11/2005 Liu ..... 369/4
7,010,371 B2 * 3/2006 Liu ..... 700/94
7,012,184 B2 * 3/2006 Bastian ..... 84/612

(Continued)

FOREIGN PATENT DOCUMENTS

WO WO 97/01168 * 1/1997 ..... G10H 1/00

*Primary Examiner* — David S. Warren
(74) *Attorney, Agent, or Firm* — Waddey Patterson; Ryan D. Levy; Mark A. Pitchford

(57) ABSTRACT

An electronic musical instrument includes a platter, rotational position sensor, and a processor. The platter can be rotated about a center point by a user. The rotational position sensor senses rotation of the platter and provides a position signal indicative of the sense rotation of the platter. The buffer stores a sound sample. The processor receives the position signal from the rotational position sensor, determines a rotational position of the platter as a function of the position signal, retrieves a sound sample from a buffer, shifts a frequency of the sound sample as a function of the determined rotational position of the platter, and renders the frequency-shifted sound sample. The instrument may also include user inputs for selecting octaves per rotation and scale divisions within each octave which further define the frequency shift applied by the processor as a function of the determined rotational position of the platter.

20 Claims, 4 Drawing Sheets

(56) References Cited

U.S. PATENT DOCUMENTS

| | | | | |
|---|---|---|---|---|
| 7,041,892 | B2 * | 5/2006 | Becker | 84/603 |
| 7,087,830 | B2 * | 8/2006 | Kent et al. | 84/645 |
| 7,115,807 | B2 * | 10/2006 | Yamada et al. | 84/602 |
| 7,218,578 | B2 * | 5/2007 | Usui | 369/30.27 |
| 7,235,732 | B2 * | 6/2007 | Becker | 84/602 |
| 7,238,874 | B2 * | 7/2007 | Bastian | 84/612 |
| 7,273,980 | B2 * | 9/2007 | Wardle | 84/645 |
| 7,514,622 | B2 * | 4/2009 | Yoshikawa | 84/609 |
| 7,566,827 | B2 * | 7/2009 | Mazur et al. | 84/723 |
| 7,592,534 | B2 * | 9/2009 | Yoshikawa et al. | 84/612 |
| 7,615,702 | B2 * | 11/2009 | Becker et al. | 84/612 |
| 7,683,249 | B2 * | 3/2010 | Becker | 84/602 |
| 7,763,843 | B2 * | 7/2010 | Flum et al. | 250/231.18 |
| 7,787,342 | B2 * | 8/2010 | Yamada et al. | 369/53.37 |
| 7,889,605 | B2 * | 2/2011 | Yamada et al. | 369/30.18 |
| 7,928,313 | B2 * | 4/2011 | Flum et al. | 84/723 |
| 7,964,782 | B2 * | 6/2011 | Liu | 84/600 |
| 7,999,167 | B2 * | 8/2011 | Yoshikawa et al. | 84/600 |
| 8,053,660 | B2 * | 11/2011 | Flum et al. | 84/725 |
| 8,077,568 | B2 * | 12/2011 | Spencer | 369/47.35 |
| 8,110,734 | B2 * | 2/2012 | Flum | 84/615 |
| 8,116,892 | B2 * | 2/2012 | Huang | 700/94 |
| 8,153,881 | B2 * | 4/2012 | Coppard et al. | 84/615 |
| 8,153,883 | B2 * | 4/2012 | Flum et al. | 84/743 |
| 8,217,252 | B2 * | 7/2012 | Bastian | 84/612 |
| 8,314,321 | B2 * | 11/2012 | Wun et al. | 84/615 |
| 8,362,349 | B2 * | 1/2013 | Mazur et al. | 84/723 |
| 8,502,058 | B2 * | 8/2013 | Bastian | 84/612 |
| 2002/0176327 | A1 * | 11/2002 | Yamada et al. | 369/30.26 |
| 2002/0194976 | A1 * | 12/2002 | Rossum | 84/1 |
| 2003/0029305 | A1 * | 2/2003 | Kent et al. | 84/645 |
| 2003/0167907 | A1 * | 9/2003 | Annen | 84/615 |
| 2004/0177746 | A1 * | 9/2004 | Becker | 84/612 |
| 2005/0081699 | A1 * | 4/2005 | Becker | 84/604 |
| 2005/0152236 | A1 * | 7/2005 | Wardle | 369/39.01 |
| 2006/0000345 | A1 * | 1/2006 | Yoshikawa | 84/616 |
| 2007/0227337 | A1 * | 10/2007 | Yoshikawa et al. | 84/602 |
| 2008/0148922 | A1 * | 6/2008 | Morra | 84/600 |
| 2008/0212437 | A1 * | 9/2008 | Kataoka et al. | 369/53.41 |
| 2009/0324192 | A1 * | 12/2009 | Ogura et al. | 386/66 |
| 2011/0094369 | A1 * | 4/2011 | Liu | 84/645 |

* cited by examiner

PLATTER BASED ELECTRONIC MUSICAL INSTRUMENT

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronic musical instruments and methods of playing electronic musical instruments. More particularly, this invention pertains to a platter (e.g. turntable) based electronic musical instrument.

Despite advances in electronics and music, new musical instruments are rarely introduced. The Theremin is one of the only true electronic musical instruments, but its limited sound and constant output reduce it to a novelty rather than a respected musical instrument. Other electronic musical instruments include keyboards and electric guitars, but these instruments only mimic prior acoustic instruments.

BRIEF SUMMARY OF THE INVENTION

Aspects of the present invention provide a platter based electronic musical instrument operable to shift the frequency of the sound sample as a function of a rotational position of the platter.

In one aspect, an electronic musical instrument includes a platter, a rotational position sensor, a buffer, and a processor. The platter is operable to rotate about a center point and is operable to be rotated by a user. The rotational position sensor is operable to sense rotation of the platter and provide a position signal indicative of the sensed rotation of the platter. The buffer is operable to store a sound sample. The processor is operable to receive the position signal from the rotational position sensor, determine a rotational position of the platter as a function of the position signal, retrieve the sound sample from the buffer, shift a frequency of the sound sample as a function of the determined rotational position of the platter, and render the frequency-shifted sound sample.

In another aspect, a method of operating or playing an electronic musical instrument includes providing a sample selection input at a sample selector of the electronic musical instrument. The sample selection input indicates a selected sound sample of a plurality of sound sample stored in a memory of the electronic musical instrument. A user (i.e., operator or player) of the electronic musical instrument then rotates a platter of the electronic musical instrument about the center point of the platter to indicate a selected frequency shift in the selected sound sample. A processor of the electronic musical instrument retrieves the selected sound sample from a buffer of the electronic musical instrument, shifts a frequency of the retrieved sound sample as a function of the rotational position of the platter, and renders the frequency-shifted sound sample.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
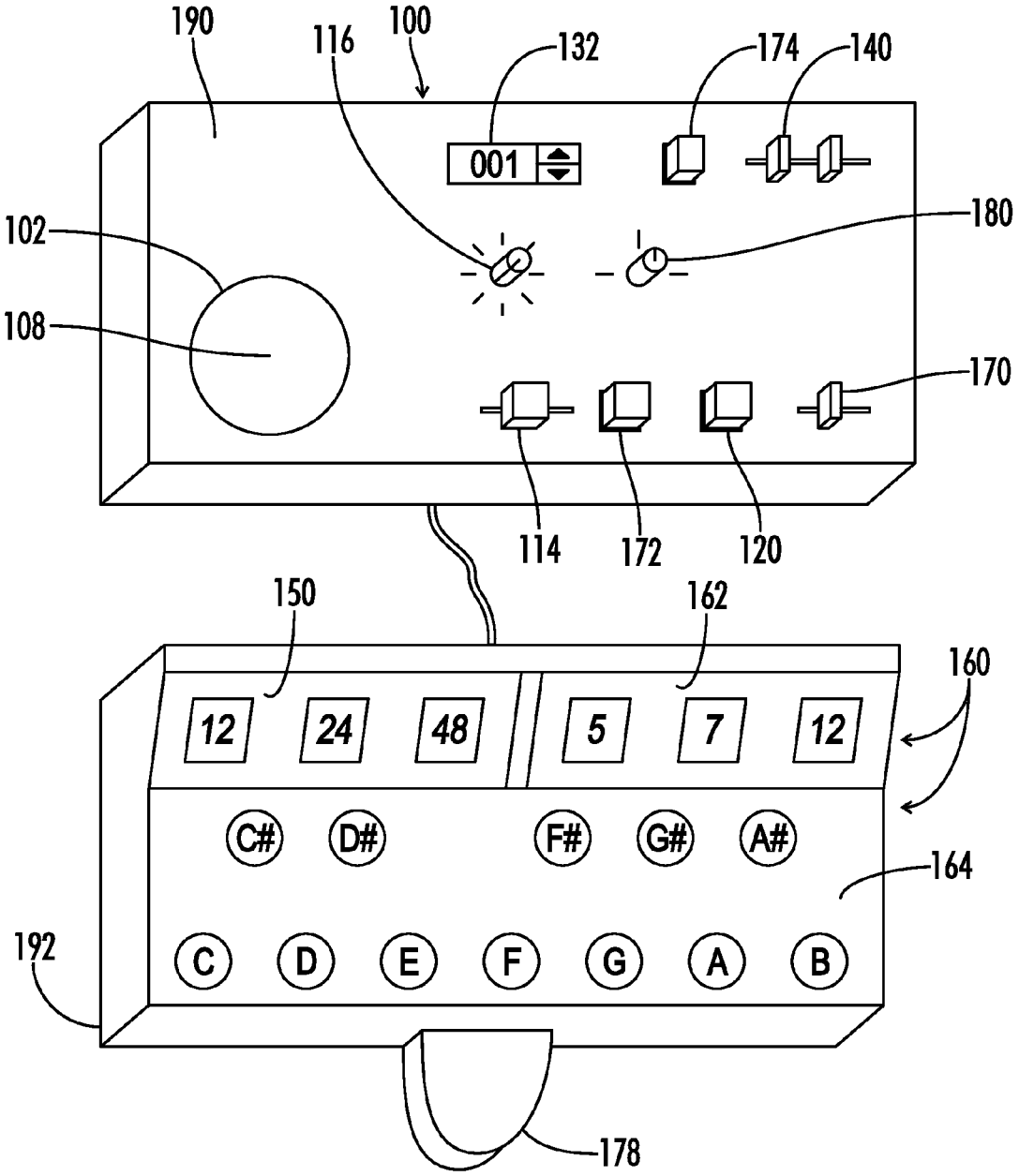
FIG. 1 is an isometric view of an electronic musical instrument.
Figure 2:
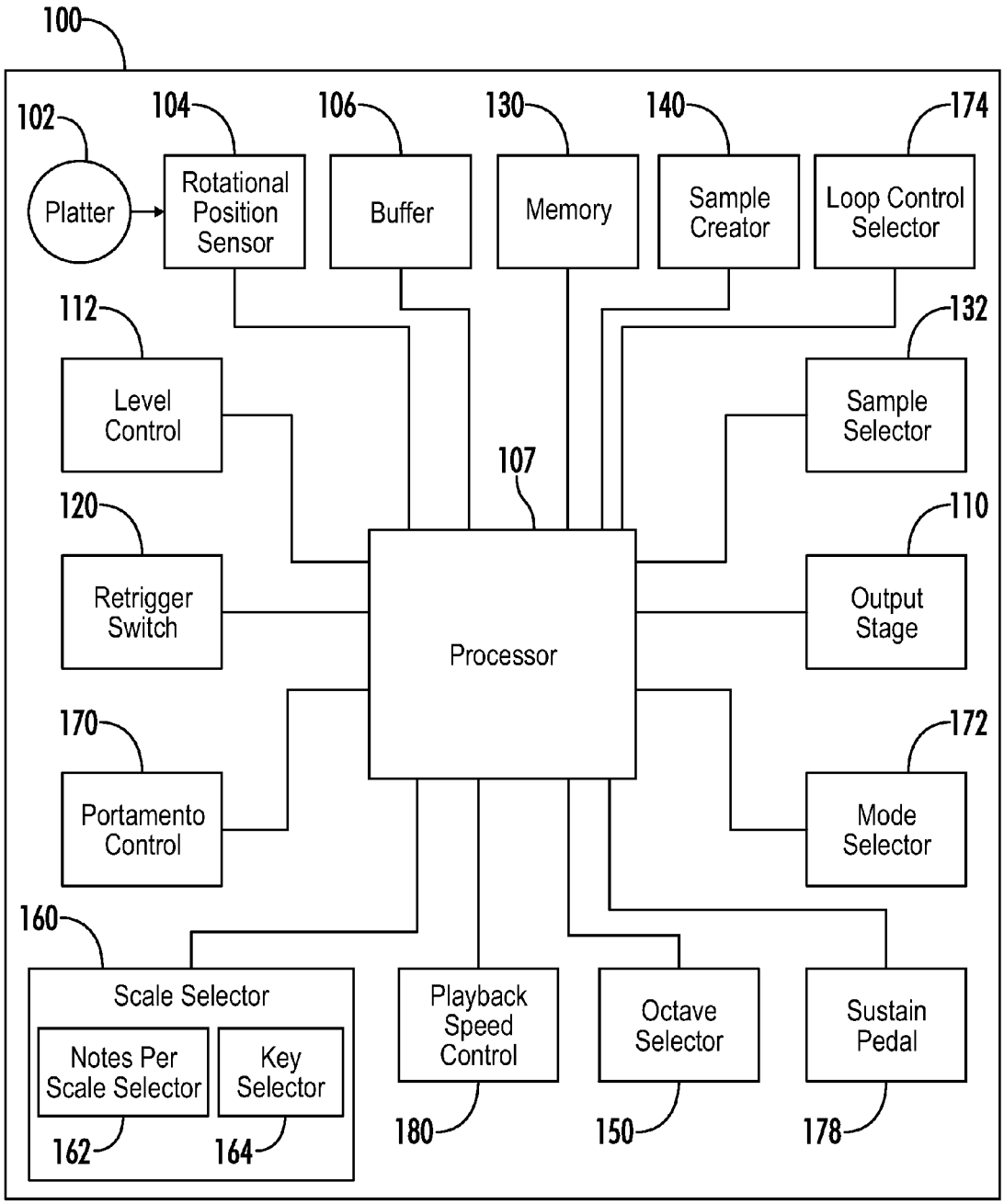
FIG. 2 is a block diagram of an electronic musical instrument.
Figure 3A:
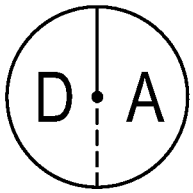
FIG. 3A is a diagram of logical divisions of a platter of the musical instrument showing two divisions per octave and a single octave per rotation.

Referring to FIGS. 1 and 2, an electronic musical instrument 100 includes a platter 102, a rotational position sensor 104, a buffer 106, and a processor 107. The platter 102 is operable to rotate about a center point 108 and is operable to be rotated by the user (i.e., operator or player) of the musical instrument 100. The rotational position sensor 104 is operable to sense rotation of the platter 102 and provide a position signal indicative of the sense rotation of the platter to the processor 107. The buffer 106 is operable to store a sound sample. The processor 107 is operable to receive the position signal from the rotational position sensor 104. Although the platter 102 rotates about the center point 108, the center point 108 is not indicative of a spindle system. It is contemplated within the scope of the claims that the platter 102 and rotational position sensor 104 may be part of a spindle system or a rail or bearing assembly located at or adjacent to a perimeter of the platter 102. In one embodiment, a center section of the platter 102 does not rotate and is equipped with a display to provide data to a user. The display may show, for example, a number of positive (e.g., clockwise) or negative (e.g., counterclockwise) rotations from a zero position of the platter 102, a selected scale, and/or a selected octaves per rotation.

The processor 107 determines a rotational position of the platter 102 as a function of the received position signal. In one embodiment, the position signal is indicative of a change in the rotational position of the platter 102, and the processor 107 determines the rotational position of the platter 102 as a function of the change in the rotational position indicated by the position signal and a previous rotational position of the platter 102. In another embodiment, the position signal is directly indicative of the rotational position of the platter 102. That is, the rotational position sensor 104 is an encoder that provides a unique code of a plurality of unique codes, with each unique code indicative of a rotational position of the platter 102, to the processor 107. In one embodiment, the platter 102 is a turntable such as that found in modern disc jockey equipment.

The processor 107 further retrieves the sound sample from the buffer 106 and shifts a frequency of the sound sample as a function of the determined rotational position of the platter 102. In one embodiment, the processor 107 automatically tunes (i.e., frequency shifts) the sound sample to a predetermined base frequency prior to shifting the frequency of the sound sample as a function of the determined rotational position of the platter 102. In another embodiment, the processor 107 shifts the frequency of the sound sample without altering an inherent base frequency of the sound sample. As used herein, the base frequency may be an average frequency of the sound sample or a frequency at a beginning of the sound sample.

The processor 107 further renders the frequency-shifted sound sample. In one embodiment, rendering the frequency-shifted sound sample includes transforming the frequency-shifted sound sample into an analog signal and providing the analog signal to an output stage 110 of the electronic musical instrument.

In one embodiment, the electronic musical instrument 100 further includes a level control 112. The level control 112 is operable to receive a level input from the user and to provide a level signal to the processor 107, indicative of the level input received from the user. The processor 107 is operable to restart (i.e., retrigger) rendering of the frequency-shifted sound sample from the beginning of the sound sample when the level control 112 is moved from a zero position of the level control 112. It is contemplated that the zero position of the level control 112 may not be absolute zero of the level control 112. That is, electronic musical instrument 100 may account for a velocity of decrease in the level input to determine the zero position and/or may determine that values close to absolute zero of the level control 112 are sufficient to restart rendering of the frequency-shifted sound sample. That is, the electronic musical instrument 100 may have a window near zero that is determined as zero. The window varies as a function of the velocity with which the level control 112 is moved by a user toward absolute zero. The faster the level control 112 is moved toward the absolute zero position, the wider the window is. In operation, each time the level control 112 is increased rapidly from a non-zero level to near zero (i.e., absolute zero or within the variable window near zero) and back, processor 107 restarts rendering of the frequency-shifted sound sample. In one embodiment, the processor 107 is further operable to render the frequency-shifted sound sample at a volume level corresponding to the level input received at the level control 112. In one embodiment, the level control 112 is a volume fader 114, and in another embodiment, the level control 112 is a volume knob 116. It is contemplated that a single musical instrument 100 may include both a volume fader 114 and a volume knob 116 to suit the preferences of different users (i.e., operators or players). In one embodiment, the electronic musical instrument 100 includes a mode selector 172 associated with the level control 112. The mode selector 172 may be a button or two position switch operable to switch between a first mode of the level control 112 and a second mode of the level control 112. In the first mode of the level control 112, the level control 112 retriggers the sound sample as described above (i.e., restarts rendering of the sound sample from the beginning of the sound sample). In the second mode of the level control 112, the level control 112 does not retrigger the sound sample. Instead, the sound sample is retriggered or restarted by other devices, methods, and inputs as further described below (e.g., direct retrigger via a retrigger switch 120 and scrub mode wherein the time position within the sound sample is determined by a rotational position of the platter 102 within a logical division of the platter 102).

In one embodiment, the electronic musical instrument 100 also includes a retrigger switch 120. The retrigger switch is operable to receive a retrigger input from the user and provide a retrigger signal indicative of the received retrigger input. The processor 107 is operable to restart rendering the frequency-shifted sound sample as a function of the retrigger signal or in response to receiving the retrigger signal. That is, the processor 107 jumps back to the beginning of the sound sample and continues rendering the frequency shifted sound sample from the beginning. In one embodiment, the retrigger switch 120 is a button operable to be depressed by a hand or a foot of the user. The retrigger switch 120 may be a momentary contact switch that is momentarily closed upon depressing of the switch by the hand or foot of the user. The retrigger switch 120 may also be a normally closed momentary switch that is momentarily opened upon depressing of the switch by the hand or foot of the user.

In one embodiment, the musical instrument 100 has a retrigger mode (i.e., retrigger via the level control 112 or the retrigger switch 120) and a scrub mode (see below). In the retrigger mode, the processor 107 has a first render mode and a second render mode. In the first render mode, the processor 107 renders the frequency-shifted sound sample from beginning to end and stops rendering the sound sample at the end of the sound sample, assuming no retrigger event restarts rendering of the sound sample from the beginning. In the second render mode, the processor 107 renders the frequency-shifted sound sample from beginning to end and, upon reaching the end, repeats rendering the frequency shifted sound sample from the beginning. In one embodiment, the electronic musical instrument 100 includes a loop control selector 174 to select between the first render mode and the second render mode.

In one embodiment, the electronic musical instrument 100 further includes a memory 130 and a sample selector 132. The memory 130 is operable to store a plurality of sound samples. The sample selector 132 is operable to receive a sample selection input from the user selecting a sound sample of the plurality of sound samples stored in the memory 130. The sample selector 132 provides a sound sample selection signal indicative of the selected sound sample to the processor 107. The processor 107 is further operable to receive the sound sample selection signal and retrieve the selected sound sample of the plurality of sound samples from the memory 130. The processor 107 stores the retrieved selected sound sample of the plurality of sound samples in the buffer 106 for frequency shifting and rendering as described above. It is contemplated within the scope of the claims that the memory 130 and buffer 106 may be integral with one another, and that both may also be integral with the processor 107. In such an embodiment, receiving the sound sample selection signal from the sample selector 132 at the processor 107 causes the processor 107 to queue the selected sound sample for frequency shifting and rendering as described above.

In one embodiment, the electronic musical instrument 100 further includes a sample creator 140. The memory 130 is operable to store a sound stream. The sound stream may be captured from an external device via an input port or microphone of the electronic musical instrument 100, previously recorded and stored in the memory 130, imported to the memory 130 from an external storage device, or samples previously stored in the memory 130. The sample creator 140 receives sample creation input from the user selecting a start point of the sound stream and an end point of the sound stream. The sample creator 140 provides creation signals indicative of the selected start point and selected end point to the processor 107. The processor 107 receives the creation signals from the sample creator 140 and stores a portion of the sound stream between the start point and the end point in the buffer 106 as the sound sample for frequency shifting and rendering. In one embodiment, the sample creator 140 is a range slider. In one embodiment, the electronic musical instrument 100 includes a second output stage, and the processor 107 is operable to render the sound stream and provide the rendered sound stream to the second output stage such that the user can provide the sample creation input while the processor 107 is rendering the selected sound sample and providing the rendered selected sound sample to the output stage 110. For example, the second output stage may be a secondary headphone output while the output stage 110 is the primary output.

Referring to FIGS. 3A through 5C, a plurality of user-selectable example configurations of octaves per rotation of the platter 102 and logical divisions per octave are shown. For illustrative purposes, the divisions per octave are shown as musical notes. Musical notes in a scale and adjacent octaves of scales are predefined frequency differentials between one another. Therefore, although written as specific musical notes, the actual frequencies rendered by the electronic musical instrument 100 will vary as a function of the selected sound sample. It is also contemplated, that the base frequency of each selected sound sample may be varied in order to achieve particular musical notes in a particular scale or set of scales. In FIGS. 3A through 5C, octaves are delineated by solid lines, and divisions or notes within an octave are delineated by dashed or broken lines.

Referring to FIGS. 1-5C, in one embodiment, the electronic musical instrument 100 also includes a scale selector 160. The scale selector 160 is operable to receive scale selection input from the user. The scale selection input selects a scale of a plurality of scales. The scale selector is further operable to provide a scale selection signal indicative of the selected scale to the processor 107. The processor receives the scale selection signal and shifts the frequency of the sound sample as a function of the selected scale and the determined rotational position of the platter 102. The selected scale defines relative frequency shifts within an octave and between adjacent octaves. For example, FIG. 3A shows a scale having two musical notes. Selecting a next musical scale in FIG. 3B shows an 8 note scale in the octave with different logical divisions. In operation, if the platter 102 is in an 8 o'clock rotational position while the scale of FIG. 3A is selected, assuming that the sound sample has a base frequency of middle C, the frequency shift applied to the sound sample would shift the frequency of the sound sample to the frequency corresponding to a D note. When the user selects the scale corresponding to that of FIG. 3B, the frequency shift determined by the processor as a function of the selected scale and the rotational position of the platter 102 would change to a frequency shift corresponding to the frequency differential between middle C and F#. Further, when the user selects the scale corresponding to that of FIG. 3C, the frequency shift determined by the processor is a function of the selected scale and the rotational position of the platter 102 would change to a frequency shift corresponding to the frequency differential between middle C and E. In one embodiment, the scale selector 160 comprises an array of buttons, with each button of the array corresponding to one of a plurality of scales to be applied within an octave.

Figure 4A:
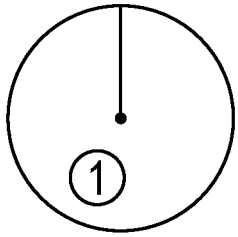
FIG. 4A is a diagram of logical divisions of a platter of the musical instrument showing a single octave per rotation.
Figure 3B:
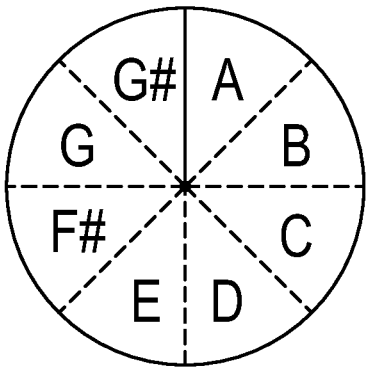
FIG. 3B is a diagram of logical divisions of a platter of the musical instrument showing eight divisions per octave and a single octave per rotation.
Figure 4B:
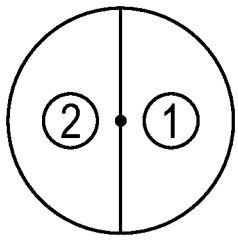
FIG. 4B is a diagram of logical divisions of a platter of the musical instrument showing two octaves per rotation.
Figure 3C:
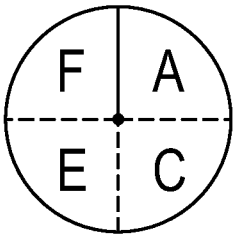
FIG. 3C is a diagram of logical divisions of a platter of the musical instrument showing four divisions per octave and a single octave per rotation.
Figure 4C:
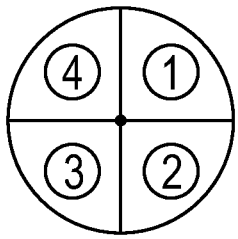
FIG. 4C is a diagram of logical divisions of a platter of the musical instrument showing four octaves per rotation.
Figure 5A:
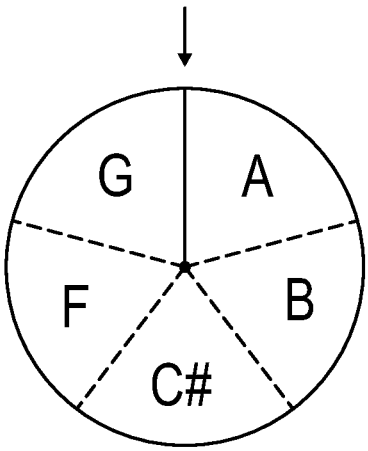
FIG. 5A is a diagram of logical divisions of a platter of the musical instrument showing five divisions per octave and a single octave per rotation.
Figure 5B:
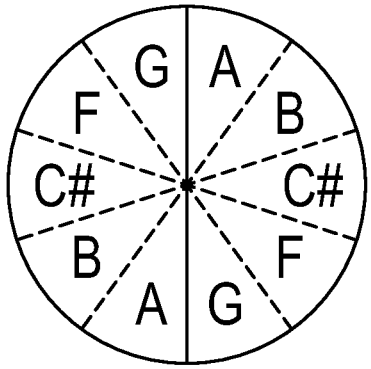
FIG. 5B is a diagram of logical divisions of a platter of the musical instrument showing five divisions per octave and two octaves per rotation.
Figure 5C:
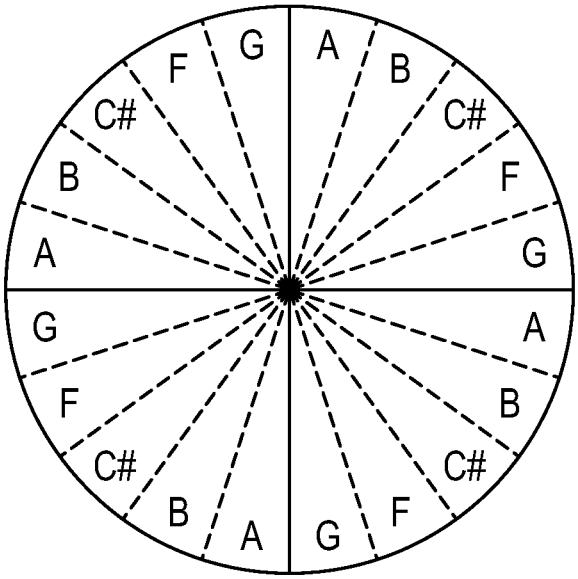
FIG. 5C is a diagram of logical divisions of a platter of the musical instrument showing five divisions per octave and four octaves per rotation.

In one embodiment, the electronic musical instrument 100 further includes an octave selector 150. The octave selector 150 is operable to receive octave selection input from the user selecting a number of octaves per rotation of the platter 102. The octave selection input 150 is further operable to provide an octave selection signal indicative of the selected number of octaves per rotation to the processor 107. The processor 107 is operable to receive the octave selection signal and shift the frequency of the sound sample as a function of the selected number of octaves per rotation and the determined rotational position of the platter 102. In operation, when the user places the platter 102 in an 8 o'clock position and selects one octave per rotation is shown in FIG. 4A, the frequency shift applied by the processor 107 to the selected sound sample corresponds to the note in the 8 o'clock position of the $1^{st}$ octave above middle C. When the user selects two octaves per rotation as shown in FIG. 4B, leaving the platter 102 in the 8 o'clock position, the frequency shift applied by the processor 107 to the selected sound sample corresponds to the note in the 8 o'clock position of the second octave above middle C. When the user selects four octaves per rotation as shown in FIG. 4C, leaving the platter 102 in the 8 o'clock position, the frequency shift applied by the processor 107 to the selected sound sample corresponds to the note in the 8 o'clock position of the $3^{rd}$ octave above middle C. In one embodiment, the octave selector 150 includes an array of buttons, with each button of the array of buttons corresponding to a number of octaves per rotation of the platter 102. FIGS. 5A-5C show the octaves of FIGS. 4A-4C with a five note scale applied. Leaving the platter in the 8 o'clock position while switching from 1 to 2 to 4 octaves per rotation changes the frequency shift applied by the processor 107 to the selected sound sample from the frequency differential between middle C and F to the differential between middle C and B an octave above middle C to the differential between middle C and F two octaves above middle C.

Although described herein as shifting the frequency of the selected sound sample up from its base frequency, it is contemplated that the electronic musical instrument can also shift the base frequency of the selected sound sample down from its base frequency. This would be accomplished, for example, by rotating the platter 102 counterclockwise from a starting position corresponding to the base frequency of the selected sample.

In a retrigger mode, as described above, the electronic musical instrument 100 may restart rendering of the sound sample in response to a direct input (e.g., retrigger input 120) or a determined input or inference (e.g., level control 112 being decreased to near zero and back). In one embodiment, the electronic musical instrument also includes a scrub mode. In the scrub mode, the processor 107 is operable to render the retrieved sound sample as a function of a change in the determined rotational position of the platter 102. In the scrub mode, the length of the sample is mapped to each logical division of the platter 102. That is, the temporal length of the sound sample is mapped to a section of circumference allotted to each logical division or note. This enables the user to control the speed of the scrub through the selected sound sample at a pace determined by the user (i.e., control the playback speed of the selected sound sample via the platter 102) while also controlling the frequency shift of the selected sound sample. In this scrub mode, the sound sample may be frequency locked (i.e., "key locked") or allowed to pitch bend (i.e., analog playback mode) as selected by the user. When the frequency is locked (i.e., the base frequency of the sound sample is locked) and the user rotates the platter 102 at a rotational velocity that does not correspond to the native playback speed of the sound sample, the processor repeats or skips small sections of the sound sample to maintain the base frequency of the sound sample. The user may thus scrub backward or forward temporally through the sound sample without changing the frequency shift applied to the sound sample by the processor 107 by rotating the platter 102 to different positions within a single note (i.e., logical division).

In one embodiment, the scale selector 160 includes a notes per scale selector 162 and a key selector 164. The notes per scale selector 162 includes an array of buttons, with each button operable to select a notes per scale division (e.g., 5 notes per octave, 7 notes per octave, or 12 notes per octave). The key selector 164 also includes an array of buttons, with each button of the array corresponding to a key or base frequency of the selected scale. That is, the combination of the notes per scale selected via the notes per scale selector 162 and the key selected via the key selector 164 forms the scale selected by the scale selector 160. Although described above with reference to a base frequency of middle C for simplicity, it is contemplated that selecting a different key via the key selector 164 may shift the frame of reference for the entire frequency shift pattern implemented via the logical divisions of the platter 102. That is, the key selector 164 is operable to transpose the relative frequency shifts between logical divisions of the platter 102, and in some embodiments, may alter the base frequency of the sound sample as rendered by the processor 107.

In one embodiment, the electronic musical instrument further includes a portamento or glide control 170. When operating in the retrigger mode and transitioning between two notes or logical divisions corresponding to different frequency shifts of the sound sample, the processor 107 normally applies a discontinuous transition from a first frequency shift to a second, different frequency shift. In this operation, the slew rate is zero. The portamento control 170 is operable to change the slew rate from zero to a positive, non-zero rate. In one embodiment, the portamento control 170 provides the processor 107 a time indicative of the time in which the processor 107 should transition from the first frequency shift to the second frequency shift and the processor 107 changes the frequency shift linearly from the first frequency shift to the second frequency shift (i.e., the rate of change is variable while the time of the transition is constant). In another embodiment, the portamento control 170 provides the processor 107 a slew rate, and the processor 107 changes the frequency shift from the first frequency shift to the second frequency shift at the rate of change indicated by the portamento control 170 (i.e., the time of the transition is variable while the rate of change is constant).

In one embodiment, the musical instrument 100 further includes a playback speed control 180. The playback speed control 180 is operable to vary the rendering speed of the sound sample in the buffer 106 (i.e., the speed with which the processor 107 advances through rendering the sound sample in the buffer 106). In one embodiment, the playback speed may be adjusted positively and negatively from a native playback speed of the sound sample, and the processor 107 is operable to compensate (i.e., frequency lock or key lock) the sound sample such that the base frequency of the sound sample is not altered by the change in the playback speed.

It is contemplated within the scope of the claims that any of the buffer 106, processor 107, and memory 130 may be integral with or separate from one another. It is further contemplated that any of the components of the musical instrument 100 may be within a housing 190 of the musical instrument, or within a separate housing such as a foot-pedal housing 192. It is further contemplated that various selectors described herein may be duplicated in different locations (e.g., both the housing 190 and foot-pedal housing 192) and may be of the same or different types (e.g., momentary switches or two position switches).

In one embodiment, the electronic musical instrument 100 further includes a sustain pedal 178. The sustain pedal 178 provides a sustain signal to the processor 107. While receiving the sustain signal, the processor 107 sustains rendering of the frequency-shifted sound sample. In the retrigger mode, the electronic musical instrument 100 may play out the sound sample to the end of the sound sample or continue rendering the sound sample while fading the sound sample out, similarly to the operation of a sustain pedal of a piano. In the scrub mode, the processor 107 may repeat a small portion of the sound sample being rendered at a constant volume level when the sustain pedal 178 is activated, or the processor 107 may repeat the small portion of the sound sample being rendered at a decreasing volume level, similarly to the operation of a sustain pedal of a piano. In one embodiment, a sustain pedal selector provides input to the processor 107 for selecting between the effect of the sustain signal provided by the sustain pedal 178 to the processor 178.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, DVD, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, includes at least one or more processors or processing units and a system memory. The controller may also include at least some form of computer readable media. By way of example and not as a limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful PLATTER BASED ELECTRONIC MUSICAL INSTRUMENT, it is not intended that such references be construed as limitations upon the scope of this invention except as set forth in the following claims.

What is claimed is:

1. An electronic musical instrument comprising:

a platter operable to rotate about a center point, wherein the platter is operable to be rotated by a user;

a rotational position sensor operable to sense rotation of the platter and provide a position signal indicative of the sensed rotation of the platter;

a buffer operable to store a sound sample; and a processor operable to:

determine a rotational position of the platter as a function of the position signal;

retrieve the sound sample from the buffer;

shift a frequency of the sound sample as a function of the determined rotational position of the platter; and render the frequency-shifted sound sample; and an octave selector operable to receive octave selection input from the user selecting a number of octaves per rotation of the platter and provide an octave selection signal indicative of the selected number of octaves per rotation to the processor, wherein the processor is further operable to receive the octave selection signal and shift the frequency of the sound sample as a function of the selected number of octaves per rotation and the determined rotational position of the platter.

2. The electronic musical instrument of claim 1, wherein the position signal is indicative of a change in the rotational position of the platter and the processor determines the rotational position of the platter as a function of the change in the rotational position and a previous rotational position of the platter, and wherein the platter is a turntable.

3. The electronic musical instrument of claim 1, wherein the position signal is indicative of the rotational position of the platter.

4. The electronic musical instrument of claim 1, further comprising a level control operable to receive a level input from the user and provide a level signal to the processor indicative of the level input, wherein the processor is further operable to restart rendering the frequency-shifted sound sample when the level control is moved from a zero position of the level control and render the frequency-shifted sound sample at a volume level corresponding to the level input.

5. The electronic musical instrument of claim 1, further comprising a level control operable to receive a level input from the user and provide a level signal to the processor indicative of the level input, wherein the processor is further operable to restart rendering the frequency-shifted sound sample when the level control is moved from a zero position of the level control and render the frequency-shifted sound sample at a volume level corresponding to the level input, wherein the level control comprises a volume fader.

6. The electronic musical instrument of claim 1, further comprising a retrigger switch operable to receive a retrigger input from the user and provide a retrigger signal, wherein the processor is further operable to restart rendering the frequency-shifted sound sample as a function of the retrigger signal.

7. The electronic musical instrument of claim 1, further comprising a retrigger switch operable to receive a retrigger input from the user and provide a retrigger signal, wherein the processor is further operable to restart rendering the frequency-shifted sound sample as a function of the retrigger signal, and wherein the retrigger switch comprises a button operable to be depressed by a hand or a foot of the user.

8. The electronic musical instrument of claim 1, further comprising a scale selector operable to receive scale selection input from the user selecting a scale of a plurality of scales and provide a scale selection signal indicative of the selected scale to the processor, wherein the processor is further operable to receive the scale selection signal and shift the frequency of the sound sample as a function of the selected scale and the determined rotational position of the platter, and wherein the selected scale defines relative frequency shifts within an octave and between adjacent octaves.

9. The electronic musical instrument of claim 1, further comprising a scale selector operable to receive scale selection input from the user selecting a scale of a plurality of scales and provide a scale selection signal indicative of the selected scale to the processor, wherein the processor is further operable to receive the scale selection signal and shift the frequency of the sound sample as a function of the selected scale and the determined rotational position of the platter, wherein the selected scale defines relative frequency shifts within an octave and between adjacent octaves, and wherein the scale selector comprises an array of buttons, each button of the array of buttons corresponding to one of the plurality of scales.

10. The electronic musical instrument of claim 1, wherein the octave selector comprises an array of buttons, each button of the array of buttons corresponding to a number of octaves per rotation of the platter.

11. The electronic musical instrument of claim 1, further comprising:

a memory operable to store a plurality of sound samples; and a sample selector operable to receive a sample selection input from the user selecting a sound sample of the plurality of sound samples and provide a sound sample selection signal indicative of the selected sound sample to the processor, wherein the processor is further operable to:

receive the sound sample selection signal;

retrieve the selected sound sample of the plurality of sound samples from the memory; and store the retrieved selected sound sample of the plurality of sound samples in the buffer.

12. The electronic musical instrument of claim 1, further comprising:

a memory operable to store a sound stream; and a sample creator operable receive sample creation input from a user selecting a start point of the sound stream and an end point of the sound stream and provide creation signals indicative of the selected start point and the selected end point to the processor, wherein the processor is further operable to:

receive the creation signals from the sample creator; and store a portion of the sound stream between the start point and the end point in the buffer as the sound sample.

13. The electronic musical instrument of claim 1, further comprising:

a memory operable to store a sound stream; and a sample creator operable receive sample creation input from a user selecting a start point of the sound stream and an end point of the sound stream and provide creation signals indicative of the selected start point and the selected end point to the processor, wherein the processor is further operable to:

receive the creation signals from the sample creator; and store a portion of the sound stream between the start point and the end point in the buffer as the sound sample, and wherein the sample creator comprises a range slider.

14. The electronic musical instrument of claim 1, wherein the processor is further operable to render the retrieved sound sample as a function of a change in the determined rotational position of the platter within a logical division of the platter and wherein a rotational position of the platter within the logical division is mapped to a time within the sound sample.

15. An electronic musical instrument comprising:

a platter operable to rotate about a center point, wherein the platter is operable to be rotated by a user;

a rotational position sensor operable to sense rotation of the platter and provide a position signal indicative of the sensed rotation of the platter;

a buffer operable to store a sound sample; and a processor operable to:

determine a rotational position of the platter as a function of the position signal;

retrieve the sound sample from the buffer;

shift a frequency of the sound sample as a function of the determined rotational position of the platter; and render the frequency-shifted sound sample; and a memory operable to store a sound stream; and a sample creator operable receive sample creation input from a user selecting a start point of the sound stream and an end point of the sound stream and provide creation signals indicative of the selected start point and the selected end point to the processor, wherein the processor is further operable to:

receive the creation signals from the sample creator; and store a portion of the sound stream between the start point and the end point in the buffer as the sound sample, and wherein the sample creator comprises a range slider.

16. The electronic musical instrument of claim 15, further comprising:

an octave selector operable to receive octave selection input from the user selecting a number of octaves per rotation of the platter and provide an octave selection signal indicative of the selected number of octaves per rotation to the processor, wherein the processor is further operable to receive the octave selection signal and shift the frequency of the sound sample as a function of the selected number of octaves per rotation and the determined rotational position of the platter.

17. The electronic musical instrument of claim 15, wherein the processor is further operable to render the retrieved sound sample as a function of a change in the determined rotational position of the platter within a logical division of the platter and wherein a rotational position of the platter within the logical division is mapped to a time within the sound sample.

18. An electronic musical instrument comprising:

a platter operable to rotate about a center point, wherein the platter is operable to be rotated by a user;

a rotational position sensor operable to sense rotation of the platter and provide a position signal indicative of the sensed rotation of the platter;

a buffer operable to store a sound sample; and a processor operable to:

determine a rotational position of the platter as a function of the position signal;

retrieve the sound sample from the buffer;

shift a frequency of the sound sample as a function of the determined rotational position of the platter; and render the frequency-shifted sound sample;

wherein the processor is further operable to render the retrieved sound sample as a function of a change in the determined rotational position of the platter within a logical division of the platter and wherein a rotational position of the platter within the logical division is mapped to a time within the sound sample.

19. The electronic musical instrument of claim 18, further comprising:

an octave selector operable to receive octave selection input from the user selecting a number of octaves per rotation of the platter and provide an octave selection signal indicative of the selected number of octaves per rotation to the processor, wherein the processor is further operable to receive the octave selection signal and shift the frequency of the sound sample as a function of the selected number of octaves per rotation and the determined rotational position of the platter.

20. The electronic musical instrument of claim 18, further comprising:

a memory operable to store a sound stream; and a sample creator operable receive sample creation input from a user selecting a start point of the sound stream and an end point of the sound stream and provide creation signals indicative of the selected start point and the selected end point to the processor, wherein the processor is further operable to:

receive the creation signals from the sample creator; and store a portion of the sound stream between the start point and the end point in the buffer as the sound sample, and wherein the sample creator comprises a range slider.

* * * * *